US010744518B2

(12) United States Patent
Overberg

(10) Patent No.: US 10,744,518 B2
(45) Date of Patent: Aug. 18, 2020

(54) METHOD FOR MONITORING A SCREW CENTRIFUGE TO IDENTIFY DYNAMIC CHANGES IN RELATIVE ANGULAR OFFSET BETWEEN AN OUTPUT SHAFT AND A TRANSMISSION INPUT SHAFT

(71) Applicant: GEA MECHANICAL EQUIPMENT GMBH, Oelde (DE)

(72) Inventor: Martin Overberg, Herzebrock-Clarholz (DE)

(73) Assignee: GEA MECHANICAL EQUIPMENT GmbH, Oelde (DE)

( * ) Notice: Subject to any disclaimer, the term of this patent is extended or adjusted under 35 U.S.C. 154(b) by 0 days.

(21) Appl. No.: 16/329,486

(22) PCT Filed: Jun. 12, 2017

(86) PCT No.: PCT/EP2017/064255
§ 371 (c)(1),
(2) Date: Feb. 28, 2019

(87) PCT Pub. No.: WO2018/041432
PCT Pub. Date: Mar. 8, 2018

(65) Prior Publication Data

US 2019/0224691 A1 Jul. 25, 2019

(30) Foreign Application Priority Data

Sep. 1, 2016 (DE) ..... 10 2016 116 391

(51) Int. Cl.
*B04B 7/06* (2006.01)
*B04B 1/20* (2006.01)
(Continued)

(52) U.S. Cl.
CPC ..... *B04B 7/06* (2013.01); *B04B 1/2016* (2013.01); *B04B 9/10* (2013.01); *B04B 13/00* (2013.01); *B04B 13/003* (2013.01)

(58) Field of Classification Search
CPC ..... B04B 7/06; B04B 13/003; B04B 1/2016; B04B 13/00; B04B 9/10
See application file for complete search history.

(56) References Cited

U.S. PATENT DOCUMENTS 5,941,810 A 8/1999 Gay
5,948,271 A * 9/1999 Wardwell ..... B04B 1/20 210/143
(Continued)

FOREIGN PATENT DOCUMENTS

DE 4333526 A1 4/1995
DE 69110210 T2 10/1995
(Continued)

OTHER PUBLICATIONS

International Search Report dated Sep. 13, 2017 in related/corresponding International Application No. PCT/EP017/064255.
(Continued)

*Primary Examiner* — Charles Cooley
(74) *Attorney, Agent, or Firm* — Patent Portfolio Buiders PLLC

(57) ABSTRACT

A method for monitoring a screw centrifuge, such as a solid-bowl or a screen-type screw centrifuge. The screw centrifuge processes a product so that solids conveyed out of the drum with the screw are removed from the product. A current angular speed and an average angular speed of the transmission input shaft for the screw over time are determined. The current and average angular speeds are evaluated and a warning signal and/or changing one or more operating parameters of the screw centrifuge is changed if dynamic
(Continued)

a)

Figure 1:
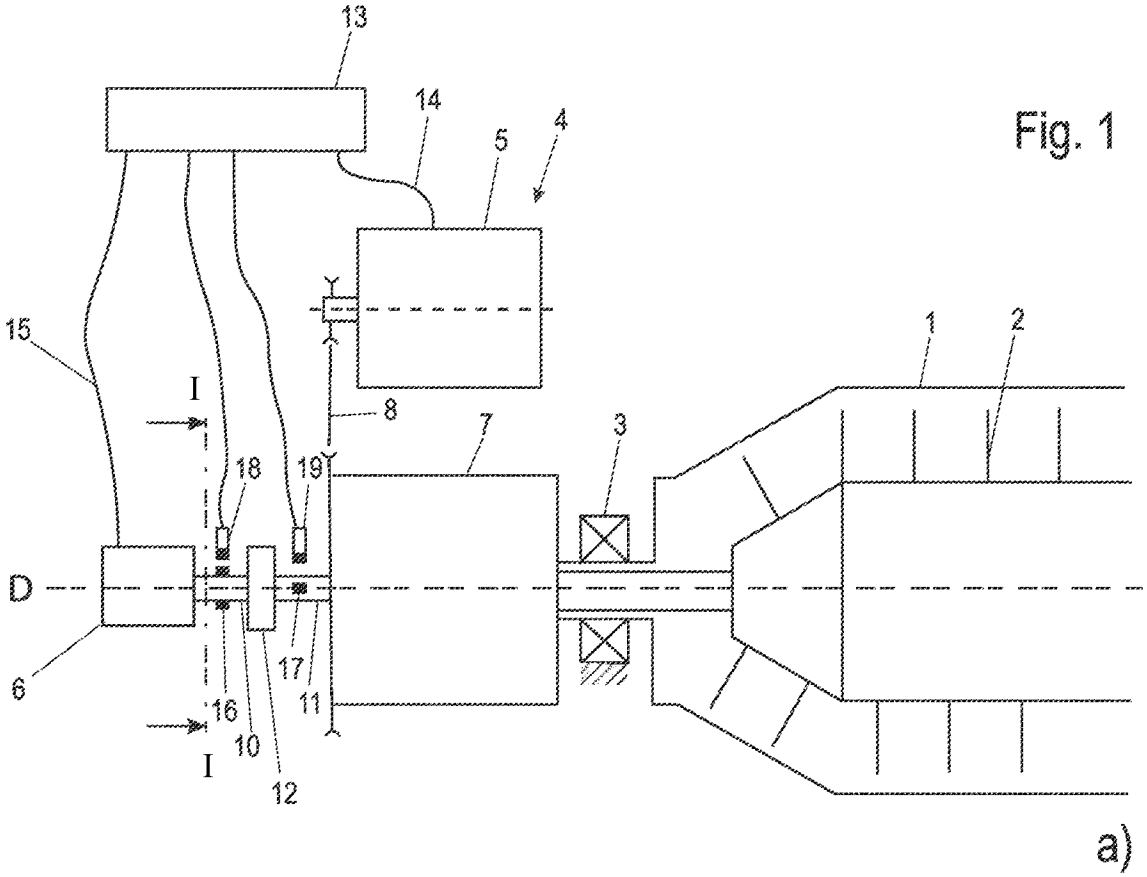
Figure 1:
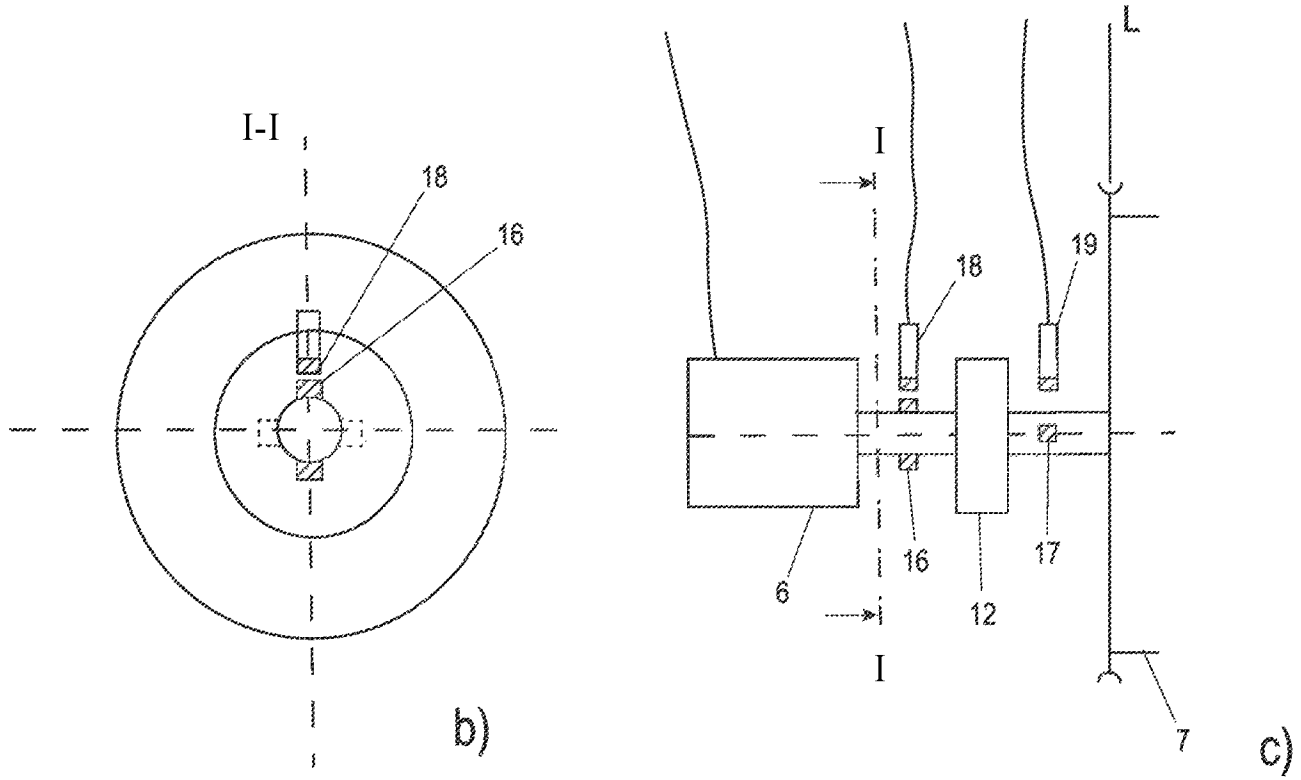

changes in the angular speed are detected during the evaluation.

14 Claims, 6 Drawing Sheets

(51) Int. Cl.
*B04B 13/00* (2006.01)
*B04B 9/10* (2006.01)

(56) References Cited

U.S. PATENT DOCUMENTS 6,143,183 A * 11/2000 Wardwell ..... B04B 1/20 210/143
6,368,264 B1 * 4/2002 Phillips ..... B04B 1/20 494/30
6,905,452 B1 * 6/2005 Kirsch ..... B04B 1/2016 494/53
6,971,982 B1 * 12/2005 Kirsch ..... B04B 1/2016 494/53
7,387,602 B1 * 6/2008 Kirsch ..... B04B 1/2016 494/53
7,883,457 B2 2/2011 Overberg
9,283,572 B2 * 3/2016 Derrick ..... B04B 1/2016
10,639,649 B2 * 5/2020 Fleuter ..... B04B 11/04
2015/0072850 A1 * 3/2015 Derrick ..... B04B 1/2016 494/8
2019/0224691 A1 * 7/2019 Overberg ..... B04B 1/2016

FOREIGN PATENT DOCUMENTS

DE 102006028804 A1 12/2007
EP 0798046 A1 10/1997
WO 2013/183287 A1 * 12/2013
WO 2014174258 A1 10/2014

OTHER PUBLICATIONS

Office Action dated Jul. 24, 2017 in related/corresponding DE Application No. 10 2016 116 391.0.
Search Report dated May 22, 2017 in related/corresponding DE Application No. 10 2016 116 391.0.
Stahl, "Industrie-Zentrifugen," Band II, 2004, pp. 453-454, DrM Press, Männedorf, CH.
Stahl, "Industrie-Zentrifugen," Band III, 2008, pp. 1-45, DrM Press, Männedorf, CH.
Written Opinion dated Sep. 13, 2017 in related/corresponding International Application No. PCT/EP017/064255.

* cited by examiner a)

METHOD FOR MONITORING A SCREW CENTRIFUGE TO IDENTIFY DYNAMIC CHANGES IN RELATIVE ANGULAR OFFSET BETWEEN AN OUTPUT SHAFT AND A TRANSMISSION INPUT SHAFT

BACKGROUND AND SUMMARY OF THE INVENTION

Exemplary embodiments of the invention relate to a method for monitoring a screw centrifuge.

The screw centrifuge to be monitored may have been configured as a solid-bowl screw centrifuge, or as a screen-bowl screw centrifuge, for instance.

EP 0 798 046 A1 discloses a centrifuge drive with two motors—a primary motor and a variable-speed motor—and with a three-stage transmission. On three shafts a torque is either introduced into the transmission or picked up from it.

DE 10 2006 028 804 A1 discloses a screw centrifuge with a centrifuge drive with two motors—a primary motor and a variable-speed motor—and with a three-stage transmission. In this case, torques are capable of being introduced into the first transmission stage and the second transmission stage or capable of being picked up from these two transmission stages on a total of at least four shafts, in which connection, furthermore, the first and second transmission stages are particularly preferably capable of being driven (and, as a rule, are also driven) on at least three shafts, the first motor feeding a torque both into the housing and into the first transmission stage on two shafts.

In the course of the operation of a screw centrifuge, the difference in rotational speed between the drum and the screw is set by the mechanism of the machine or by the actuation of a variable-speed motor. However, in some applications of the screw centrifuge—that is to say, in the course of a separation of a product from solids conveyed out of the drum by the screw—under, for the most part, indeterminate operating conditions the so-called "stick-slip effect" may arise. This stick-slip effect between drum and screw is associated with strong surges of torque (sometimes even with fluctuating directions of torque), which load the drivetrain and, under certain circumstances, may even lead to damage and to stoppage of the plant if they are not noticed in time.

In contrast, exemplary embodiments of the invention are directed to a method for monitoring a screw centrifuge, with which an onset of a stick-slip effect can be ascertained in good time.

According to an embodiment, a method for monitoring a screw centrifuge, in particular a solid-bowl centrifuge or a screen-bowl centrifuge, including the following: a rotatable drum, a rotatable screw arranged in the drum, a main or primary motor at least for driving the drum, a drive motor for driving the screw (within the scope of this document, this also means, in particular, influencing the difference in rotational speed of the screw relative to the drum), which may be the main or primary motor or a secondary motor, and also a transmission arranged between the motor or motors and the drum and screw, transmission input shafts for the main motor and the drive motor for the screw, wherein one or more pulse-generators are arranged at least on the transmission input shaft for the screw, to each of which a proximity-sensor is assigned, with the following steps:

a) providing the screw centrifuge, and processing of a product with the screw centrifuge, in the course of which the product is separated from solids which are conveyed out of the drum by the screw, b) (repeated, continual) determining a current angular velocity and determination of a mean angular velocity of the transmission input shaft for the screw over time, c) (repeated) evaluating the measurements from step b), and d) outputting a warning signal and/or variation of one or more operating parameters of the screw centrifuge, to the extent that dynamic changes of angular velocity are ascertained in the course of the evaluation.

In step b), the measurements of the current angular velocity of a last period—for example, the last 10 seconds—are, for example, averaged, and the mean value is continually updated to this extent. In addition, the current angular velocity is determined, and changes of this value in comparison with the mean value are then registered. Dynamic changes are, in particular, periodic changes.

In this regard, a reference time for one revolution is preferentially ascertained in the no-load state, and deviations from this time are converted into corresponding angles in the course of the subsequent measurements.

According to another embodiment, there is a method for monitoring a screw centrifuge, in particular a solid-bowl screw centrifuge or a screen-bowl screw centrifuge, which includes the following: a rotatable drum, a rotatable screw arranged in the drum, a primary motor for driving the drum and a secondary rotor for driving the screw, and also a transmission, arranged between the motors and the drum and screw, with transmission input shafts for the primary motor and the secondary motor, an elastic element between an output shaft of the secondary motor and the transmission input shaft for the secondary motor, wherein pulse-generators are arranged on the output shaft of the secondary motor and on the transmission input shaft on both sides of the elastic element, to each of which there are assigned proximity-sensors, with the following steps:

a) providing the screw centrifuge, and processing of a product with the screw centrifuge, in the course of which the product is separated from solids which are conveyed out of the drum by the screw, b) (repeated) measuring a relative angular offset over time between the output shaft and the transmission input shaft on both sides of the elastic element connecting these shafts, c) (repeated) evaluating the measurements from step b), and d) outputting a warning signal and/or variation of one or more operating parameters of the screw centrifuge, to the extent that dynamic changes—that is to say, changes that are not constant over a predeterminable time-interval—of angular offset are ascertained in the course of the evaluation. In this regard, dynamic changes are, in particular, periodic changes.

In accordance with the invention, according to variants of the methods described above, it is possible in each instance to notice the incipient onset of the stick-slip effect in good time. This makes it possible to output a warning, to find a better operating point by procedural measures or by a variation of settings—such as a variation of the difference in rotational speed, of the rotational speed of the drum, or of the product feed quantity—or, in case this is necessary for the purpose of protecting the machine, to switch off the decanter.

The elastic element is preferentially an elastic coupling. But the elastic element may also be constituted by a drive belt if a belt drive has been provided between the output shaft and the transmission input shaft for the secondary motor.

A torque-dependent twist-angle of the coupling (or of the belt drive) between the secondary motor and the transmission input shaft on both sides of the elastic element is preferentially measured with high temporal resolution, and harmonic changes of this angle are detected. By virtue of this measurement or these measurements, the stick-slip effect can be detected particularly well in good time. In the case of a belt drive, where appropriate a gear ratio is incorporated correspondingly into the ascertainment.

In this case it is advantageous, and advantageous for the purpose of ensuring a good measurement, if the pulse-generators on the two shafts have been arranged in a fixed angular relationship, for instance with a phase shift—that is to say, with a corresponding angular offset—preferentially with a phase shift between 0° and 360°, and if the pulse-generators have been configured in such a manner that in the course of rotations of the output shaft one pulse or two or more pulses of the pulse-generators are sensed per revolution. Especially in the latter case, a measurement result can be achieved that can be evaluated particularly well.

The output signals of the proximity-sensors are preferentially read out or registered at a high sampling-rate or sampling-frequency by the control device, which with a suitable software measuring program, constitutes a measuring system, the sampling-rate being greater, preferentially several times greater, than the frequency of revolution of the transmission input shaft. Accordingly, it is expedient if the sampling-rate for a screw speed between 1000 revolutions/min and 10,000 revolutions/min amounts to between 2.5 kHz and 250 kHz. The stiffer the elastic element—in particular, the elastic coupling—has been designed to be, the higher the resolution of the measurement of the angle of torsion is intended to be. For this purpose, a correspondingly high sampling-rate of the sensors is required. Theoretically, eigenfrequencies may in fact perturb the measuring process. It is therefore preferred that no eigenfrequencies of the elastic element lie within the range of measurement of the system, since otherwise eigenfrequencies possibly cannot be distinguished, or can only be distinguished with difficulty, from oscillations by reason of stick-slip effects. But should an eigenfrequency of the elastic element nevertheless lie within the range of measurement and be excited/measured, in principle this is not problematic. For in this case it is possible to change one or more control parameters for actuating the centrifuge appropriately, in order to get out of the eigenfrequency range.

In the course of the further evaluation of the measurements, it is advantageous to ascertain a dynamic change of the angular offset between the output shaft and the transmission input shaft based on the result of a mathematical transformation method, in particular by means of a fast Fourier transformation method, since such a method permits the developing stick-slip effect to be detected particularly well in good time.

BRIEF DESCRIPTION OF THE DRAWING FIGURES

Figure 2:
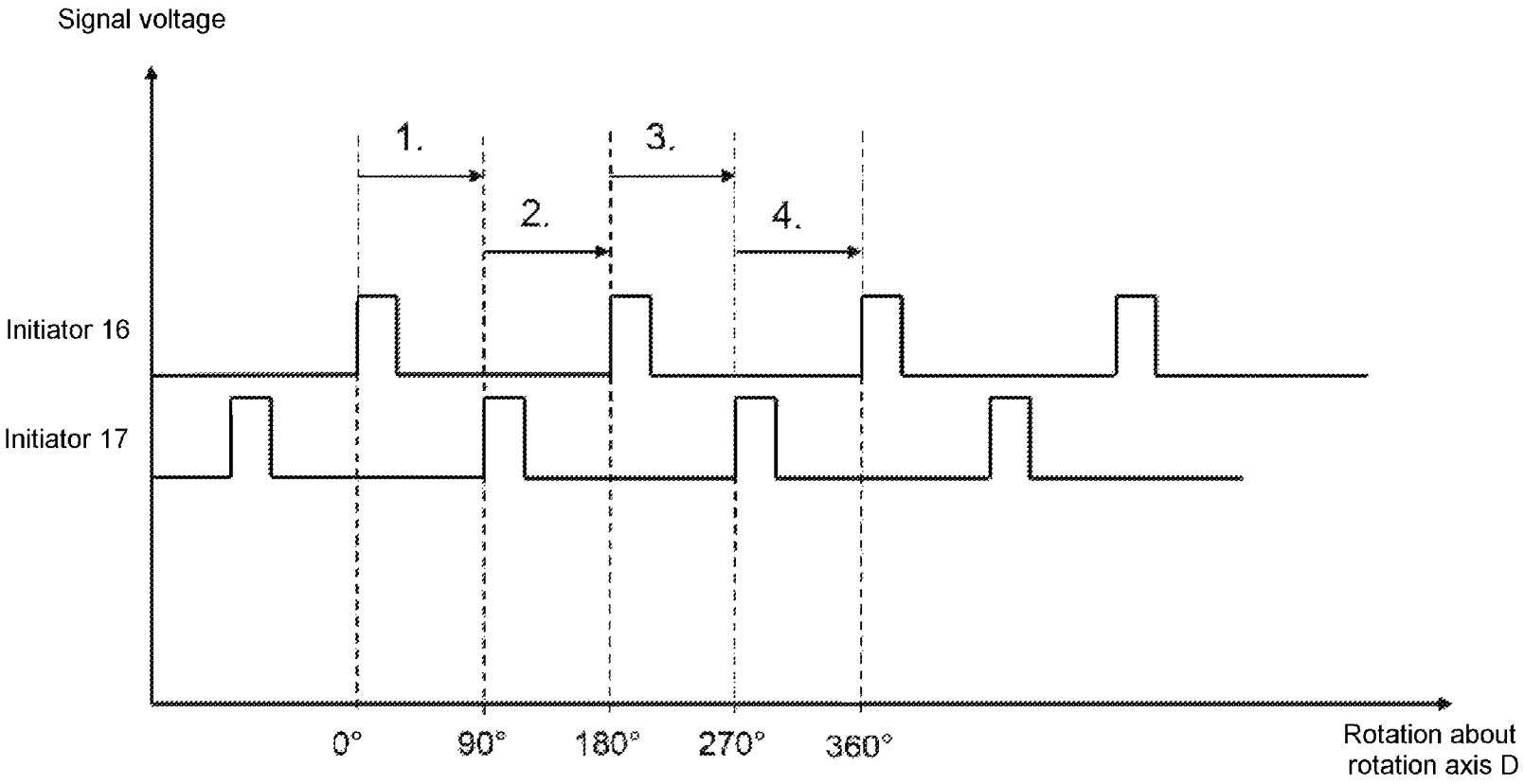
Figure 3:
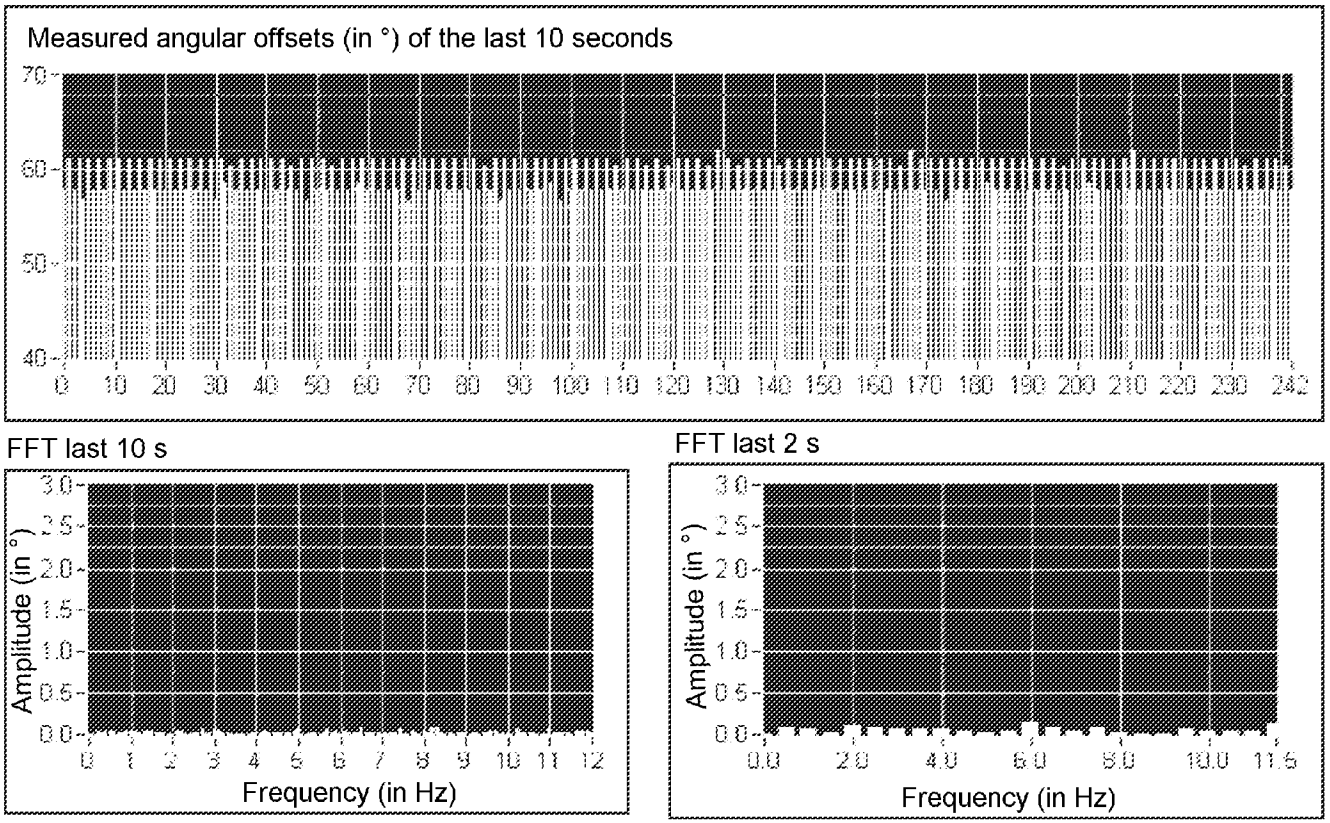
Figure 4:
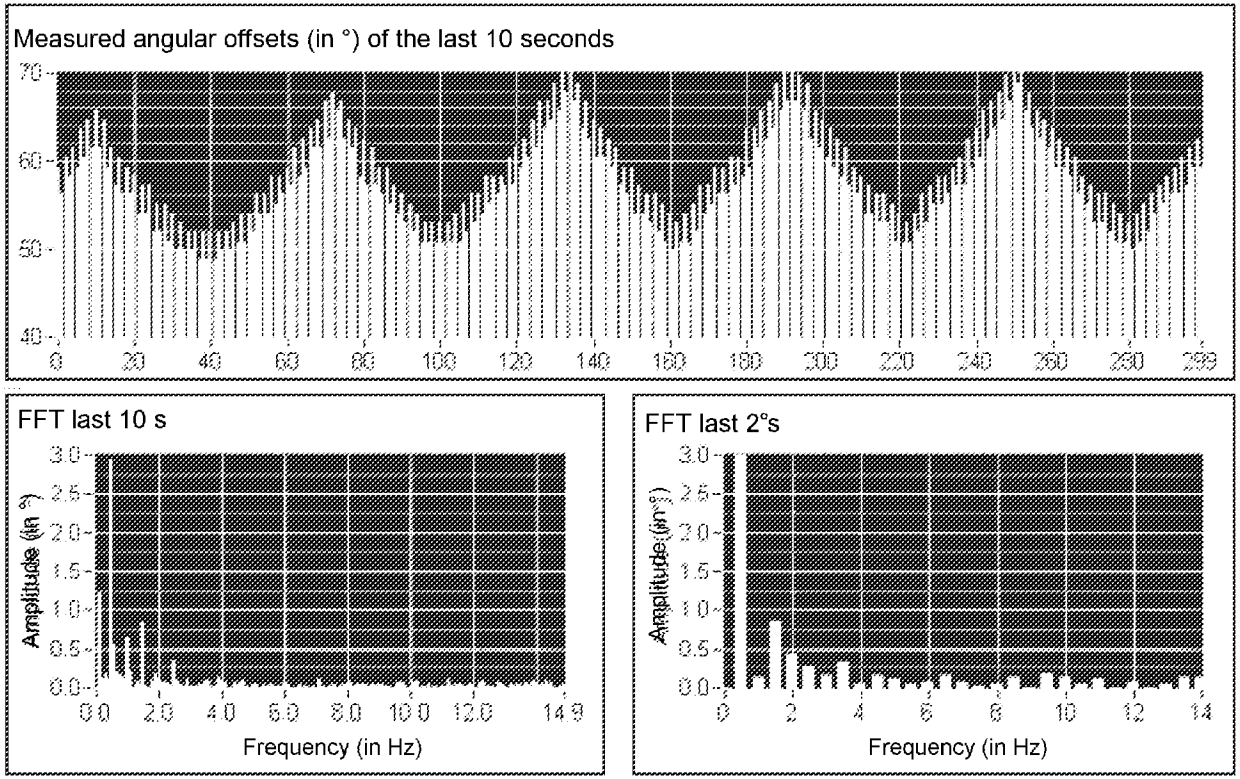

The invention will be discussed in more detail in the following with reference to the drawing on the basis of embodiments. Shown are:

FIG. 1 in a), a schematic side view of a portion of a solid-bowl screw centrifuge with its drive and with a monitoring device; in c), an enlargement of a detail from a); and, in b), a sectional view of the arrangement from c) along line I-I from c), in each instance for implementing a first variant of an alternative monitoring method;

FIG. 2 a measurement diagram for illustrating a measurement carried out with the monitoring device;

FIGS. 3, 4 further diagrams for illustrating the invention; and

Figure 5:
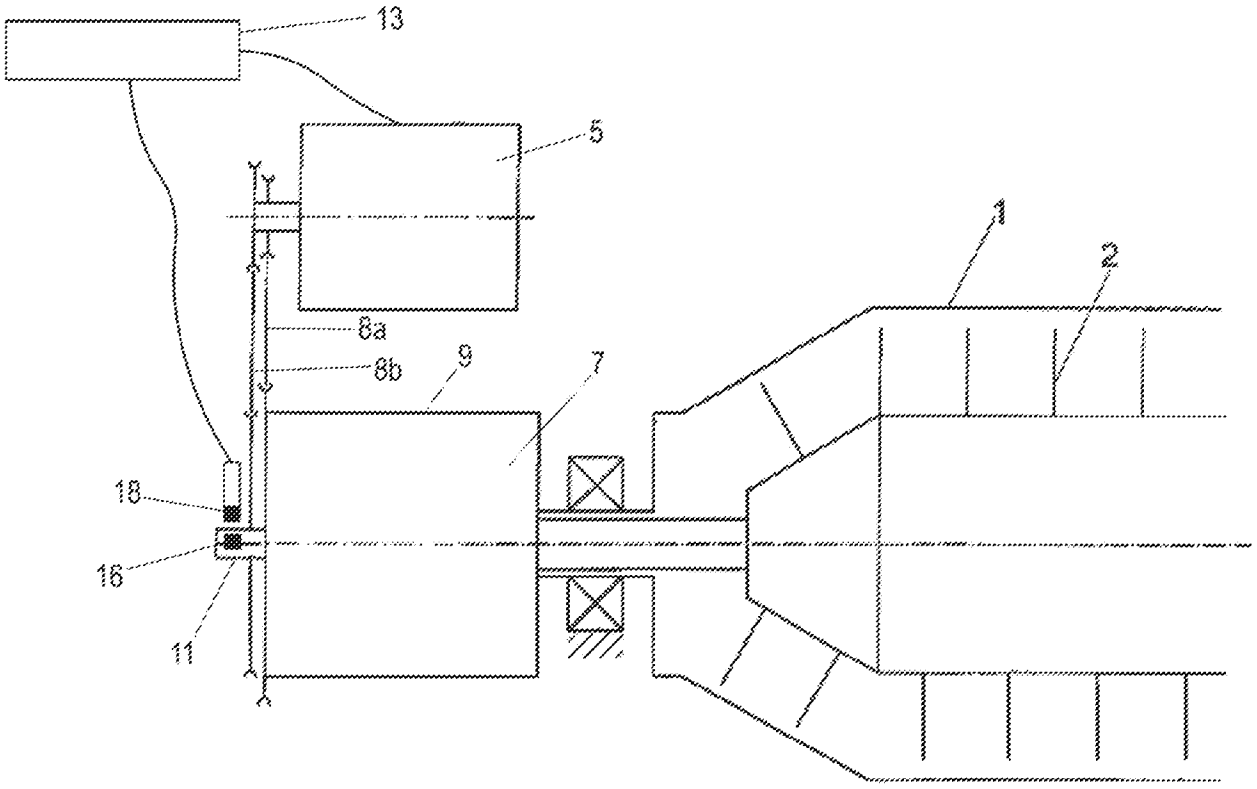

FIG. 5 a schematic side view of a portion of a further solid-bowl screw centrifuge with its drive and with an alternatively configured monitoring device for implementing an alternative monitoring method.

DETAILED DESCRIPTION

FIG. 1*a* shows a portion of a solid-bowl screw centrifuge—hereinafter called screw centrifuge for short—with a rotatable drum 1 with a rotation axis D, which here is a horizontal rotation axis D. A likewise rotatable screw 2 is arranged in the drum 1. The drum is arranged between a drive-side drum bearing and a drum bearing facing away from the drive, of which only the drive-side drum bearing 3 is represented here. Additionally, for the sake of comprehension in this respect, reference is made, by way of example, to DE 10 2006 028 804 A1 which shows a complete drum and also the further drum bearing.

The screw centrifuge includes a centrifuge drive 4 for rotating the drum 1 and the screw 2. For this purpose, the centrifuge drive 4 includes a primary motor 5 and a secondary motor 6—also called a variable-speed motor—and also a transmission 7, arranged between the motors 5, 6 and the drum 1 and the screw 2, into which, in operation, both motors 5, 6 feed a torque. If a secondary motor 6 is not present, the one motor that is then present is called the main motor and not the primary motor.

In this case, by way of example the main or primary motor 5 is coupled via a belt-type drive 8 with a first input shaft 9 of the transmission 7, and the variable-speed motor 6 is coupled via an output shaft 10 and an elastic coupling 12 with a preferentially second transmission input shaft 11 of the transmission 7.

A control device 13 actuates the motors 5, 6, to which it is connected in wireless manner or via lines 14, 15.

The design of the transmission 7 and of the control device 13 is preferentially such that a difference in rotational speed between the rotational speed of the drum 1 and the rotational speed of the screw 2 is adjustable in operation.

In operation, a dependence of the difference in rotational speed between the drum 1 and the screw 2 on the slippage and on the loading-state of the screw centrifuge cannot be avoided. Under, for the most part, indeterminate operating conditions in the course of the conveying of the centrifuged solids by the screw 2, the stick-slip effect discussed above arises, associated with strong surges of torque.

For the purpose of early detection of the onset of the effect, the screw centrifuge is provided with a monitoring device or a measuring system. This monitoring device makes it possible to measure a—torque-dependent—twist-angle of an elastic element—here, the coupling 12—between the output shaft 10 of the secondary motor 6 and the transmission input shaft 11 with high temporal resolution, and to detect changes (in particular, harmonic changes) of this angle.

For this purpose, the monitoring device includes two or more proximity-sensors 18, 19, linked to the control device 13, and pulse-generators 16, 17 respectively assigned to the proximity-sensors.

Pulse-generator 16 has been arranged on the output shaft 10 of the secondary motor 6 and configured in such a way that one signal or two or more signals is/are capable of being sensed per revolution. For instance, pins have been arranged or formed on shaft 10 at two points on shaft 10 that are offset by 180° in relation to one another. Assigned to pulse-generator 16 is proximity-sensor 18 which has been arranged in such a manner and which has been designed in such a manner that in the course of rotations of the output shaft 10—here, per revolution—it senses one pulse of pulse-generator 16 or, per revolution, two or more pulses of the pulse-generators 16, 16'.

Pulse-generator 17, on the other hand, has been arranged on the transmission input shaft 11 and configured, in turn (like pulse-generator 16), in such a way that one signal or two or more signals are capable of being sensed per revolution. Assigned to pulse-generator 17 for this purpose is proximity-sensor 19, which has been arranged in such a manner and which has been designed in such a manner that in the course of rotations of the transmission input shaft 11—here, per revolution—it senses one pulse of pulse-generator 17 or, per revolution, two or more pulses of the pulse-generators 17, 17'.

The pulse-generators 17, 16 have been arranged on the two shafts 10 and 11 in a fixed angular relationship, for instance with a phase shift—that is to say, with a corresponding angular offset. By way of example, this angular offset amounts to 90° (see FIGS. 1*a* to 1*c*).

Since the pulse-generators or initiators 16, 17 have been arranged on both sides of the elastic element—here, the coupling 12—in this way it is possible to record the angular offset between the pulse-generators 17, 16 over time. The proximity-sensors 18, 19 (which have been designed, for instance, as inductive proximity-sensors, Hall sensors, or reed-type contact sensors) are for this purpose monitored by the control device 13, which with a suitable software measuring program constitutes a measuring system, at a sufficiently high sampling-rate or sampling-frequency. This sampling-rate Based on the measurement signals of the proximity-sensors 18, 19 linked to the control device 13, the current angular offset between the pulse-generators 16, 17 in operation is determined during the rotation of the drum 1 and the screw 2. Without torque loading, the measured angular offset coincides with that in the case of a reference measurement that was recorded, for instance, at the time of an initial installation of the machine (for example, 90° in figs. 1*a*-1*c* and FIG. 2). amounts to 100 kHz, for instance.

On the other hand, a temporally constant torque leads to a static deflection of the coupling 12 and therefore to a different phase shift or angular offset. This static angular offset is of no significance for the onset of the stick-slip effect.

Rather, in the event of an onset of the stick-slip effect a dynamic torque arises which brings about a dynamic change of the angular offset between the output shaft 10 and the transmission input shaft 11. This dynamic change of the angular offset is relevant here.

Depending on the number of pulses that each of the pulse-generators 16, 17 provides per revolution, it is possible for the angular offset between the pulse-generators 16, 17 to be determined, even several times per revolution of the shafts 10, 11.

For instance, in the case of two pulse-generators 16, 16' and 17, 17' in each instance and a phase offset of 90° between the four pulse-generators, four angular offsets can be ascertained per revolution of the shafts 10, 11.

These angular offsets are ascertained with the aid of the proximity-sensors 18, 19 and the control device 13, and are recorded over a period of time, and then an amplitude spectrum or the amplitude spectrum of the sequence is ascertained via a transformation, for instance an FFT (fast Fourier transform). In the case of an evaluation of four angular offsets per revolution, it is possible for oscillations up to a frequency of twice the rotational speed of the motor to be detected.

FIG. 2 shows, by way of example, a measurement such as arises without load and without stick-slip effect. There is no twisting of the coupling 12, and the signals of the proximity-sensors 18, 19, which each arise twice per revolution, are received with a phase offset of exactly 90°.

Under load, on the other hand, the flexible coupling 12 becomes twisted, so that the relative angular position of the shafts 10 and 11 in relation to one another varies. This variation is analyzable.

FIGS. 3 to 4 illustrate the method according to the invention on the basis of exemplary measurements.

FIG. 3 shows, in the upper region, angular offsets that were ascertained on the basis of measurement signals of the proximity-sensors 18, 19 in ten seconds. The two pulse-generators 16, 17 are offset here in relation to one another by about 60° and provide two pulses per revolution. Only two of the possible four angular offsets are evaluated per revolution in the example; as a result, 242 measured angular offsets arise in ten seconds (upper third of FIG. 3).

The angular offset in the example lies alternately above and below 60°. This is due to the fact that in the case of one of the pulse-generators 16, 17 the two edges are not situated 180° opposite of each other, but this is of no significance for the evaluation, since this frequency is just no longer detectable.

In the lower region of FIG. 3 the calculated amplitude spectra of the 242 values are represented, the last 10 seconds having been evaluated on the left, and only the last 2 seconds on the right.

It is conceivable to evaluate only the rising edges of FIG. 2. Though if the pulses are chosen to be longer (for example, 45°) it is advantageous to evaluate also the falling edges, since by this evaluation the number of measurements is doubled and the resolution of the measurement increases correspondingly.

FIG. 4 shows the same signals and evaluations for a state with an artificially generated oscillation having a frequency of 0.5 Hz. This is reflected quite clearly in the spectra. From the distinct amplitude excursions of the transformation over time it is possible to infer a temporally varying stick-slip effect between the drum 1 and the screw 2, which can be interpreted as an indicator of the stick-slip effect.

The described method can be used in principle for the most diverse decanters with driven or even braked transmission input shaft 11. In the case of drives with an elastic belt drive between the secondary motor 6 and the transmission input shaft, it is likewise conceivable to establish a dynamic angular deviation of the two belt pulleys from the normal gear ratio, and to ascertain the incipient stick-slip effect by an appropriate evaluation.

FIG. 5 shows a set-up for realizing another variant for preventing the stick-slip effect.

According to this set-up, the main motor 5 is designed to drive the drum 1 and the screw 2. Therefore, two belt-type drives 8*a*, 8*b* are provided, which couple the main motor 5 both with the first input shaft 9 of the transmission 7 and directly with a second transmission input shaft 11 of the transmission 7.

The control device 13 serves for actuating the motor 5.

The design of the transmission 7 and of the control device 13 is preferentially such that a difference in rotational speed between the rotational speed of the drum 1 and the rotational speed of the screw 2 is adjustable in operation.

Here too, under—for the most part—indeterminate operating conditions the stick-slip effect discussed above may arise in the course of the conveying of the centrifuged solids by the screw 2, associated with strong surges of torque.

For early detection of the onset of the effect, the screw centrifuge is provided with a variant of the monitoring device or, to be more exact, with a measuring system. This monitoring device makes it possible to measure torque-dependent fluctuations of the rotations of the transmission input shaft 11 with high temporal resolution, and to detect changes (in particular, harmonic changes) of this angle.

For this purpose, the monitoring device includes one or more proximity-sensors 18, linked to the control device 13, and pulse-generators 16 respectively assigned to said proximity-sensors.

Pulse-generator 16 has been arranged on the transmission input shaft 11 and configured in such a way that one signal or two or more signals are capable of being sensed per revolution.

In the course of the processing of a product with the screw centrifuge, in the course of which the product is separated from solids which are conveyed out of the drum 1 by the screw 2, a determination now takes place—in advance in the load-free state and/or repeatedly at intervals or incessantly, again and again in operation—of a mean angular velocity of the transmission input shaft for the screw over time. Then an evaluation of the measurements and an output of a warning signal and/or variation of one or more operating parameters of the screw centrifuge take place, to the extent that dynamic changes of angular velocity are ascertained in the course of the evaluation that satisfy a predetermined condition (for instance, an exceeding of a limiting value of the deviation). Also, in this way, an onset of the stick-slip effect can be detected in good time, and a progression of this effect can therefore, as a rule, be prevented at an early stage.

Also, in this variant of the monitoring method, the transmission input shaft 11 for the screw 2 could alternatively be driven by a secondary motor (with or without elastic element 12) instead of by a belt drive 8*b*.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

REFERENCE SYMBOLS

Drum 1
Screw 2
Drum bearing 3
Centrifuge drive 4
Motor 5
Motor 6
Transmission 7
Belt-type drive 8
Input shaft 9
Output shaft 10
Input shaft 11
Coupling 12
Control device 13
Lines 14, 15
Pulse-generators 16, 16', 17, 17'
Proximity-sensors 18, 19
Rotation axis D

The invention claimed is:

1. A method for monitoring a screw centrifuge, the method comprising:

a) providing the screw centrifuge, which comprises a rotatable drum, a rotatable screw arranged in the rotatable drum, a primary motor configured to drive the rotatable drum, and a secondary motor configured to drive the rotatable screw, and a transmission arranged between the primary and second motors and the rotatable drum and the rotatable screw, transmission input shafts for the primary motor and the secondary motor, an elastic element between an output shaft of the secondary motor and the transmission input shaft for the secondary motor, wherein pulse-generators are arranged on both sides of the elastic element on the output shaft of the secondary motor and on the transmission input shaft, to each of which there are assigned proximity-sensors, and processing a product with the screw centrifuge so that solids are separated from the product and the separated solids are conveyed out of the rotatable drum by the rotatable screw;

b) measuring, using the pulse-generators and proximity sensors, a relative angular offset over time between the output shaft and the transmission input shaft on both sides of the elastic element connecting the output shaft and the transmission input shaft;

c) evaluating the measurements from step b) to determine whether the relative angular offset over time exceeds a deviation limiting value; and d) outputting a warning signal and/or varying of one or more operating parameters for actuating the screw centrifuge responsive to a determination that dynamic changes of the relative angular offset over time occurring during the evaluation of the measurements in step c) exceeds the deviation limiting value, wherein the dynamic changes of the relative angular offset are changes in the relative angular offset that are not constant over a predetermined time interval.

2. The method of claim 1, wherein a torque-dependent twist-angle of the elastic element between the output shaft of the secondary motor and the transmission input shaft is measured on both sides of the elastic element with high temporal resolution, and that changes of the torque-dependent twist-angle are identified.

3. The method of claim 1, wherein the elastic element is a coupling.

4. The method of claim 1, wherein the pulse-generators are arranged on the output shaft for the secondary motor and the transmission input shaft in a fixed angular relationship.

5. The method of claim 1, wherein the elastic element is a drive belt.

6. The method of claim 5, wherein the pulse-generators are arranged on the output shaft for the secondary motor and the transmission input shaft in a fixed angular relationship.

7. The method of claim 1, wherein the pulse-generators are arranged on the output shaft for the secondary motor and the transmission input shaft with a phase shift between 0° and 360°.

8. The method of claim 1, wherein the pulse-generators are configured in such a manner during rotation of the output shaft one pulse or two or more pulses of the pulse-generators are sensed per revolution of the output shaft.

9. The method of claim 1, wherein, during measuring step b), output signals of the proximity-sensors are read by a controller, which with a software measuring program constitutes a measuring system, at a sampling-rate or sampling-frequency that is greater than a frequency of revolution of the transmission input shaft.

10. The method of claim 9, wherein the sampling-rate for a screw speed between 1000 revolutions/min and 10,000 revolutions/min corresponds to between 2.5 kHz and 250 kHz.

11. The method of claim 1, wherein the measurements of the angular offset between the output shaft and the transmission input shaft are evaluated in step c) based on a mathematical transformation method.

12. The method of claim 11, wherein the mathematical transformation method is a fast Fourier transform.

13. The method of claim 1, wherein in a change of a difference in rotational speed of the rotatable screw relative to the rotatable drum, a change of a rotational speed of the rotatable drum, or a change of a product feed quantity occurs in step d).

14. The method of claim 1, wherein in step d) a shutdown of the screw centrifuge occurs responsive to determining in step c) that a limiting value is exceeded.

* * * * *